United States Patent [19]

Resener

[11] 4,215,250

[45] Jul. 29, 1980

[54] MICROPHONE SUPPORT WITH SIMULTANEOUS ADJUSTMENT OF PLURAL DEGREES OF FREEDOM

[75] Inventor: Baird E. Resener, Warren, N.J.

[73] Assignee: Western Electric Company, Inc., New York, N.Y.

[21] Appl. No.: 952,277

[22] Filed: Oct. 18, 1978

[51] Int. Cl.[2] ..... H04R 1/00

[52] U.S. Cl. ..... 179/149; 179/150; 179/152; 179/155

[58] Field of Search ..... 179/146 R, 147, 148 F, 179/149, 150, 151, 152, 153, 154, 155, 156 A; 52/108, 309.16; 248/122, 160, 274

[56] References Cited

U.S. PATENT DOCUMENTS

| | | | |
|---|---|---|---|
| 2,345,393 | 3/1944 | Heyermans | 248/122 |
| 3,925,943 | 12/1975 | Petrie | 52/108 |

*Primary Examiner*—James W. Moffitt

*Attorney, Agent, or Firm*—Charles S. Phelan

[57] ABSTRACT

A microphone (11) is secured to one end of a unidirectionally flexible tape (12) which is removably storable in a housing (10) after passage through a tracking mechanism (13). That mechanism is part of a further mechanism (26, 37, 41) for holding an exiting portion of the tape in the angular orientation assumed by the tape at the end of a removal operation.

9 Claims, 17 Drawing Figures

MICROPHONE SUPPORT WITH SIMULTANEOUS ADJUSTMENT OF PLURAL DEGREES OF FREEDOM

TECHNICAL FIELD

This invention relates to a microphone support, and it relates more particularly to such a support for use in mobile radiotelephone applications.

BACKGROUND OF THE INVENTION

In mobile radiotelephone applications, it is, at times, desirable to have facilities for hands-free operation so that the driver of the vehicle need not hold a microphone or other handset while driving. It is assumed without limitation that the driver is the principal radiotelephone user. It has been found that many mobile unit users dislike microphones which are attached to their person or to their clothing in the manner often observed in the entertainment industry. In a more technical sense, it is further desirable that any microphone be located relatively close to a user's mouth in such a way as to be readily deflectable in the event of a change in position of the body of the user. Furthermore, the microphone should be so locatable with a minimum of distraction to the user.

There are a wide variety of adjustable support arrangements for subscriber telephone apparatus including microphones. One example is found in the A. Hufschmid U.S. Pat. No. 2,048,865 in which a handset articulated support of plural links is flexible in only one direction because the links are secured together by off-center transverse pins. In such an arrangement, there is basically one fixed radius of extended position, and adjustable set screws are provided to fix the height and angle of the extended support. An electric cord for the handset extends through the links and through an unpivoted end of a rotatable support for the multilink flexible support. It is at once apparent that substantial user attention is required in order to make the various adjustments for correctly positioning the multilink support member.

SUMMARY OF THE INVENTION

The problems of prior adjustable support arrangements for a microphone are alleviated in accordance with the present invention which employs as a microphone support an unarticulated member that is configured to allow flexure in substantially only one direction.

BRIEF DESCRIPTION OF THE DRAWING

A more complete understanding of the invention and its various features, objects, and advantages may be obtained from a consideration of the following detailed description and the appended claims in connection with the attached drawings in which:

DETAILED DESCRIPTION

Figure 1:
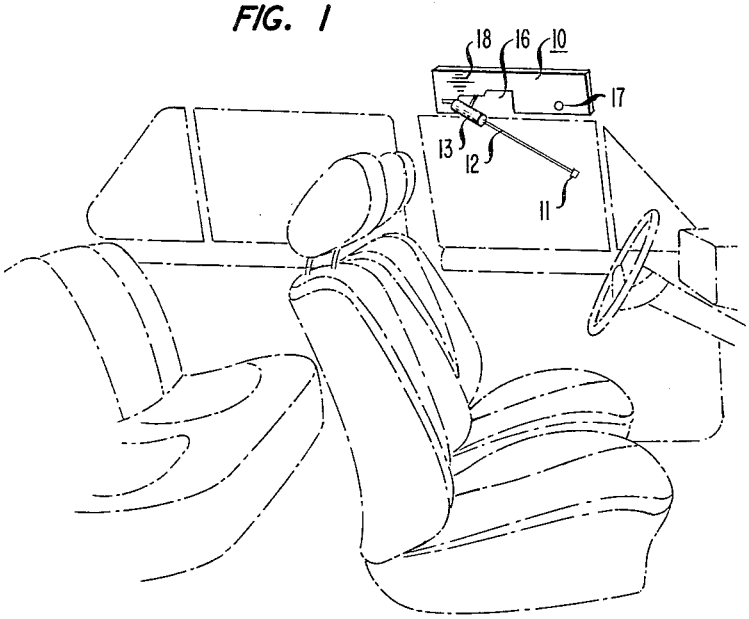
FIG. 1 is a perspective view of one application of the present invention.

FIG. 1 shows a perspective view of a hands-free microphone housing 10 utilizing the present invention. The housing is illustratively mounted in an automobile (partially indicated by broken lines) above the door next to the driver or other occupant most likely to use radiotelephone equipment with which the microphone is associated. A microphone 11 is secured to a free end of an elongated flexible member such as an unarticulated tape 12 which is configured (as will be described) to be flexible in one direction which is transverse to the longitudinal axis of the tape. That direction is, in terms of FIG. 1, substantially parallel to the housing 10 when the tape 12 is extended substantially perpendicularly to the housing.

When microphone 11 is removed to a usage position, tape 12 exits from the housing 10 through a stub boom 13 which is part of a tape orientation tracking and holding mechanism (to be described). That mechanism tracks the tape angular position with respect to the housing and, upon termination of a removal operation, holds an exiting portion of the tape adjacent to the boom in its position at that time as to both the extent of removal from the housing and the tape orientation as removed. When the tracking and holding mechanism is actuated to release the tape, a retracting mechanism in the housing 10 restores the tape in the housing and restores the boom 13 to a home position in a housing recess 16 for the boom and microphone 11. Housing 10 also advantageously includes a volume control knob 17 for adjusting the volume in a loudspeaker circuit connected to the remainder of the radiotelephone apparatus (not shown) by rotating the knob. In addition, however, the knob is also advantageously arranged, in a manner now well known in the art, to be pushed in or pulled out along its rotational axis for controlling another function. In this case the other function is the release of the aforementioned tape retracting apparatus. Housing 10 further includes a loudspeaker, as schematically indicated by the louvers 18 and in the housing 10, as well as electronics normally associated with the hands-free type of microphone and speaker combination, now well known in the art and not comprising a part of the present invention.

Figure 2:
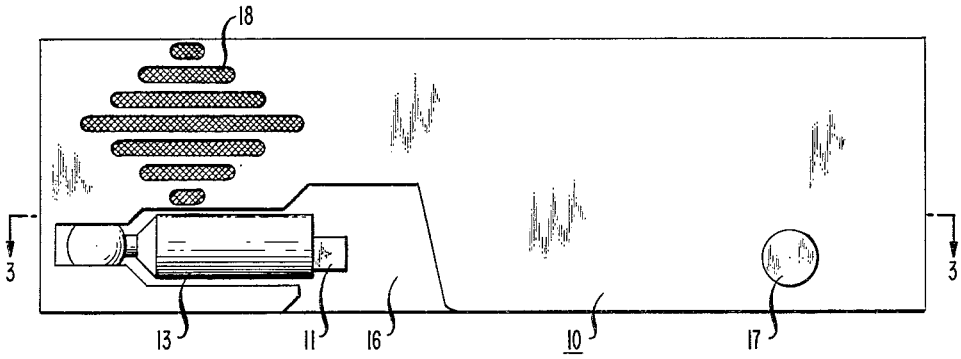
FIG. 2 is a front elevation view of a microphone housing in accordance with the present invention.

FIG. 2 shows a front elevation view of the housing 10 with the microphone 11 and boom 13 in their home positions in the recess 16.

Figure 3:
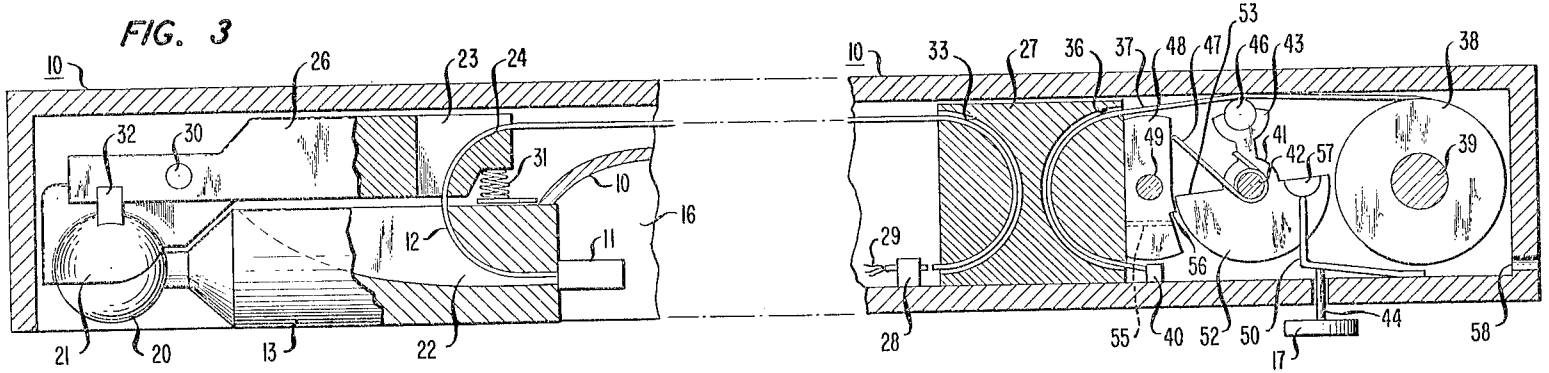
FIG. 3 is a sectional view of the embodiment of FIG. 2 taken along lines 3,3 in FIG. 2.
Figure 4:
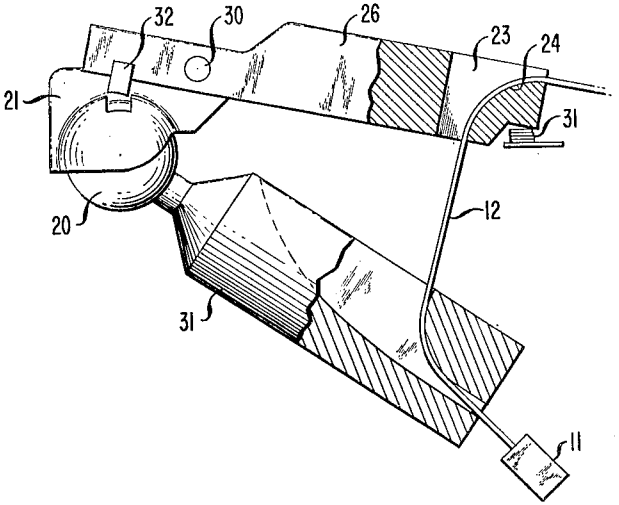
FIG. 4 is an enlarged view of a swivel arrangement employed in FIG. 3.

FIG. 3 presents a cross-sectional view of the contents of the housing 10 taken at lines 3,3 in FIG. 2. This cross-sectional view depicts the aforementioned tracking, holding, retracting, and releasing mechanisms. The housing 10 is, for example, a relatively rigid, formed metallic material which provides electromagnetic shielding between the microphone tape cable 12 and any other electric circuits which may be situated in the upper portion of the housing 10 in FIG. 2.

The stub boom 13 includes a ball 20 on one end thereof which is held in a socket 21 to form a swivel coupling between the boom 13 and the housing 10. The boom 13 includes a curving funnel shaped aperture 22 extending between the upper surface and the right-hand end surface of the boom as illustrated in FIG. 3. The large portion of the aperture 22 is in the upper (as shown in FIG. 3) face of the boom 13. Tape 12 passes through the aperture 22 and into an aperture 23 in a brake arm 26 on the way to a retraction coupling slider block 27 and a mechanical anchor point illustrated in the form of a clamp 28 which secures an end portion of the tape 12 to a nearby wall of the housing 10. A central portion of the FIG. 3 structure is broken out for convenience of illustration but is of sufficient length to allow tape extension a desired maximum distance from housing 10. Terminals for making electrical connections to conductors in the tape 12 are advantageously at connectable 29 the loose ends of these conductors. As will be subsequently further described, the tape 12 is advantageously a flexible tape having a predetermined transverse curvature when the tape is not subjected to external forces. Thus, in FIG. 3, the longitudinal edge view of the tape 12 shows simply the tape material thickness in locations where the tape is being held against another member. However, although not specifically shown in FIG. 1 portion of the aperture 22 where the tape is relieved of forces holding it against walls of passageways, it resumes its natural unrestrained curvature.

The brake arm 26 pivots about an axle 30 and is urged by a coil spring 31 in a counterclockwise direction about the axle 30 to force a brake pad 32 through a hidden slot in the socket 21 to come into frictional engagement with the ball 20. This frictional engagement under the action of spring 31 has a sufficient force normally to hold the boom 13 in position against the pull of gravity and untoward accelerations. Tape 12 passes around a curved surface on the right-hand portion of each of the apertures 22 and 23, and when the tape is under tension in excess of that exercised by gravity, etc., it exerts a clockwise rotational force on the brake arm 26 to release the engagement between brake pad 32 and the ball 20.

Thus, as the microphone 11 and tape 12 are pulled out of the housing 10, the clockwise movement of the brake arm 26 releases ball 20 and allows the boom 13 to swivel out of its FIG. 3 home position to an extended position such as that illustrated in FIG. 1. Likewise during the removing operation, the force exerted by the tape against the walls of the aperture 22 in the boom 13 causes the boom to track the tape angular orientation with respect to the housing 10. When the removing operation terminates, the tape 12 is otherwise locked with the extent of removal thus attained (as will be described) so that the only tension on the part of the tape extending through the apertures 22 and 23 is that due to the weight of the microphone 11 and the tape 12. Spring 31 then drives brake arm 26 in a counter clockwise direction to hold the ball 20 and the boom 13 in the angular orientation position thus attained.

It will be apparent that different drivers are likely to require microphone 11 positions which are unique to their respective needs so that the boom 13 may not turn in a plane which is perpendicular to the face of the housing 10. Departures from such perpendicularly will impose a limited amount of twist about the longitudinal axis of the tape 12, but such twisting will be limited to the region of the tape held between the sides of the apertures 22 and 23.

In order to avoid a need for sliding electrical contacts sometimes found in reel-type retraction mechanisms, the tape 12 passes through a first semicircular passage 33 in the slider block 27 and exits from the same face of that block to the clamp 28 already mentioned. It will be noted that the central portion of the apparatus in FIG. 3 is broken away, i.e., from a point near the lefthand side of recess 16 to a point first to the left of block 27 in its rightmost position, since the intervening part of the apparatus is merely connective and adds nothing to an understanding of the invention. However, tape 12 is also broken away just to the right of clamp 28 to indicate schematically that the clamp is actually located near the wall of recess 16 to allow maximum clearance for leftward movement of block 27. Block 27 is slidably fitted between the walls of the housing 10 to move right or left as illustrated in the drawing without binding on those walls. A second semicircular passage 36 in the block 27 accommodates a constant force spring 37 which is normally largely wound upon a drum 38 which is rotatably mounted on an axle 39. Spring 37 enters the passage 36 in the right-hand face of the block 27 and exits through the same face at the other end of the passage. A clamp 40 secures the otherwise free end of the spring 37 to the wall of the housing 10 as shown in FIG. 3.

In order to remove the microphone 11 and tape 12 from the housing 10, an appropriately directed force is applied by the user to position the microphone 11 at a convenient point in front of his mouth. This removal force on tape 12 draws the block 27 to the left against the force of the spring 37. Upon removal of the tape removing force, spring 37 tends to rewind itself upon the drum 38 and thereby pull the block 27 to the right to return it to the position illustrated in FIG. 3 and thus retract the tape and the microphone into the housing. Of course, for mobile radiotelephone applications, the user wants the microphone and tape to remain in the removed position selected by the user during the telephone communication. Therefore, an automatic spring braking mechanism is provided. This mechanism is in the form of a rotatable brake member 41 which rotates on an axle 42 and is provided with a yoke portion 43. The yoke portion holds a resilient brake pad 46 in order to bind the spring 37 between the pad and the adjacent wall of the housing 10 in the illustrated position of the yoke with the pad displaced slightly to the left of the rotational axis of the axle 42. A torsion spring 47 extends around the axle 42 and includes end portions engaging the yoke 43 and a latching pawl 48. That pawl is mounted for rotation on a further axle 49 which has its rotational axis in the same plane with the rotational axes of axles 39 and 42. Thus, in the illustrated position of the brake member 41, the spring 47 urges the brake member 41 in a clockwise direction and urges the pawl 48 in a counterclockwise direction.

When the block 27 moves to the left, during removal of the tape 12 from the housing, against the combined forces springs 37 and 47, brake member 41 rotates slightly in the counterclockwise direction thereby releasing spring 37. When the removing action ceases, spring 37 starts to rewind itself on the drum 38; but, since pad 46 is still touching spring 37, brake member 41 is thereby caused to rotate in a clockwise direction and once again grips spring 37 to prevent further retraction.

When a user wishes to retract the microphone 11 into the housing 10, it is necessary simply to push the volume control knob 17 upward as illustrated in FIG. 3. This action causes the end of the volume control shaft 14 to drive a flexible arm 50 against a shoulder 57 on the brake member 41 to rotate that member in the counterclockwise direction and thereby release the braking action. If knob 17 is completely depressed, member 41 turns far enough to allow a latching pawl 48 to engage member 41, as will be described, and thereby hold the brake released. This permits spring 37 to rewind itself upon the drum 38 until the slider block 27 restores pawl 48 to its illustrated position where block 27 is blocked by the pawl 48 from further movement to the right. Release of member 41 allows the torsion spring 47 to reestablish the braking action on tape 37 and drive the volume control knob back to its normal position.

Figure 5:
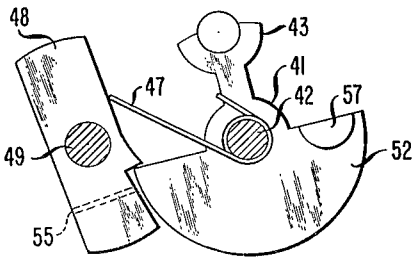
FIG. 5 is an enlarged view of a spring brake arrangement employed in the embodiment of FIG. 3.

Brake member 41 is also provided with an inertial mass portion 52 located with respect to the axle 42 so that sudden deceleration of the vehicle in which the housing is mounted will cause counterclockwise rotation of the brake member 41 through a sufficient arc so that a face 53 of the inertial mass portion 52 passes a latching face 56 on the pawl 48. Consequently, the pawl is free to rotate in a counterclockwise direction in response to the force supplied by the torsion spring 47 assuming that tape 12 is in a sufficiently extended position so that block 27 has been displaced toward the left a sufficient amount to allow the required pawl rotation. A passageway 55 between the left-hand and right-hand faces of pawl 48 had initially allowed air flow as block 27 moved to the left during tape extension to prevent vacuum drag on the block and a similar vent 58 in the right-hand wall of housing 10 cooperates to that end. However, the passageway 55 is closed by the mass portion 52 when it is latched by pawl 48. The turning of the pawl 48 locks the brake member 41 in a rotated position as illustrated, for example, in FIG. 5 and automatically maintains the brake released until tape 12 has been retracted.

Spring 37 rewinds itself to accomplish that retraction and correspondingly slides block 27 to the right. Passageway 55 is closed by mass 52 while it is latched in the brake-released position so that pawl 48 blocks substantial air flow to provide pneumatic cushioning for block 27 just before it strikes pawl 48. When the block strikes the rotated pawl 48, that pawl is thereby restored to the normal position illustrated in FIG. 3 for reengaging the braking member 41 with the spring 37.

In applications of the invention where clearances within housing 10 are sufficient to permit spring 37 to become unstable and to become kinked in the region between drum 38 and the block 27, spring edge retaining grooves (not shown in the drawing) are secured to walls of housing 10 in appropriate regions to restrain the tendency toward instability. The width of portions of spring 37 in and adjacent to passage 36 are narrower than the rest of the spring to permit passage between such grooves.

Figure 6:
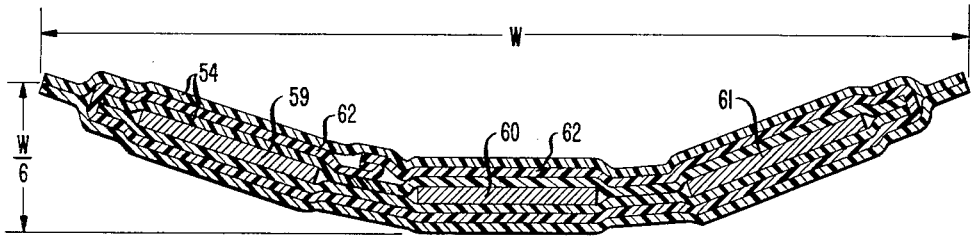
FIGS. 6 through 8 are cross-sectional views of different embodiments of a flexible support tape employed in the embodiment of FIG. 3.

FIG. 6 illustrates in transverse section one embodiment of the tape 12 in accordance with the present invention. In this embodiment, three flat strip conductors 59, 60, and 61 of an electrically conductive material such as copper are spaced in parallel relationship on a longitudinal edge-to-edge basis. Layers of insulation 54 enclose and electrically separate the conductors. An electromagnetic shielding layer 62 is applied around the insulated conductors 59–61. One example of such a material is aluminized polyethylene terephthalate plastic. A folded lap joint is utilized in layer 62 between conductors 59 and 60 to facilitate continuous electrical contact in the aluminized layer which usually is on only one side of the layer. The shielded assembly is then enclosed in a further layer of polyethylene terephthalate plastic to provide an assembly which is impervious to air and water and which has a transversely curved cross-section as shown in FIG. 6 when the tape is in its unrestrained condition. This configuration of the tape, plus its corresponding positional restraint of the flat conductors 59–61, allows the tape to bend upward, as illustrated in FIG. 6, about a transverse axis, e.g., in the plane of the drawing. The same transverse curvature of the tape also prevents similar downward bending as well as preventing bending to the right or to the left unless accompanied by a corresponding twisting force acting about the longitudinal axis of the tape. A tape having a width W of approximately 0.25 inches advantageously has a cross-sectional height, i.e., chordal depth of curvature, of approximately W/6 for a tape of approximately 0.015 inches in thickness. Tapes of such dimensions readily support microphones such as those conventionally found in hearing aids and weighing approximately 1 gram when the tape is extended distances suitable for mobile radiotelephone use, e.g., about 18 inches. Microphones of that type are typically of about the same width as the tape and when housed in a thin case centralized to the thickness of the tape apply insufficient torque to twist the tape.

Tape 12 threads the various passageways in FIG. 3 so that the concave face of the tape is toward the inside of all curves that must be negotiated. The configuration illustrated in FIG. 6 does allow an apparent departure from the flexibility limitations mentioned if a twisting force is applied about the longitudinal axis of tape in excess of a predetermined threshold which depends upon the materials and the dimensions of the tape. However, as indicated in connection wth FIG. 3, normal operation of the invention involves twisting effects only between the boom 13 and the brake arm 26 where the twisted tape portion is supported at both ends.

Figure 7:
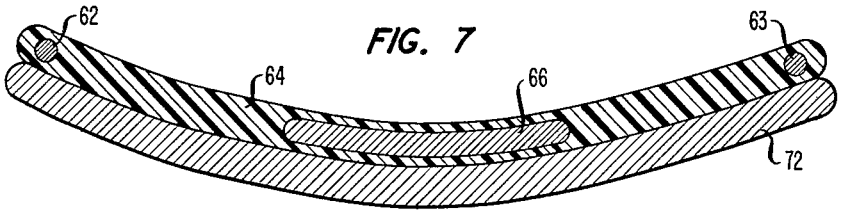

FIG. 7 illustrates in transverse section another embodiment of the invention which still utilizes the same overall transverse curved configuration. In this embodiment, two conductors 62 and 63 of circular cross-section are arranged near the longitudinal edges of the tape. A central transversely curved metallic strip conductor 66 of, for example, phosphor bronze provides a ground conductor for circuits utilizing the conductors 62 and 63. The three conductors are advantageously encapsulated in polyethylene terephthalate plastic 64. In this embodiment, the curved strip 66 enhances the previously described single degree of freedom of flexibility for the tape.

In applications of the invention wherein extra rigidity is useful in directions other than that of the single degree of freedom of flexibility, a messenger strip is advantageously provided. Such a strip is the transversely curved metallic strip 72 in FIG. 7. This strip, which is advantageously spring steel, is of the same length as strip 12 and secured to it at each end but otherwise free to slip longitudinally or transversely with respect to strip 12.

Figure 8:
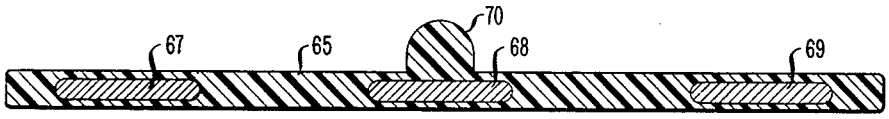
Figure 9:
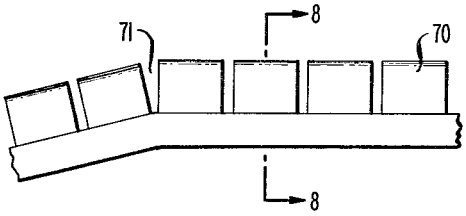
FIG. 9 is a side edge view of the tape of FIG. 8.

FIG. 8 illustrates a further embodiment including three flat strip conductors 67, 68, and 69 encapsulated in the aforementioned plastic material 65, but in this embodiment the conductors lie in a flat co-planar edge-to-edge arrangement. A ridge 70 extends along the length of the tape in the center of one side and has multiple cuts 71 through the height of the ridge at regular intervals as illustrated in FIG. 9. These cuts allow the unidirectional degree of freedom of flexibility previously described. However, this arrangement requires enlarged passages in the tape tracking, holding, and retracting mechanisms.

Figure 10:
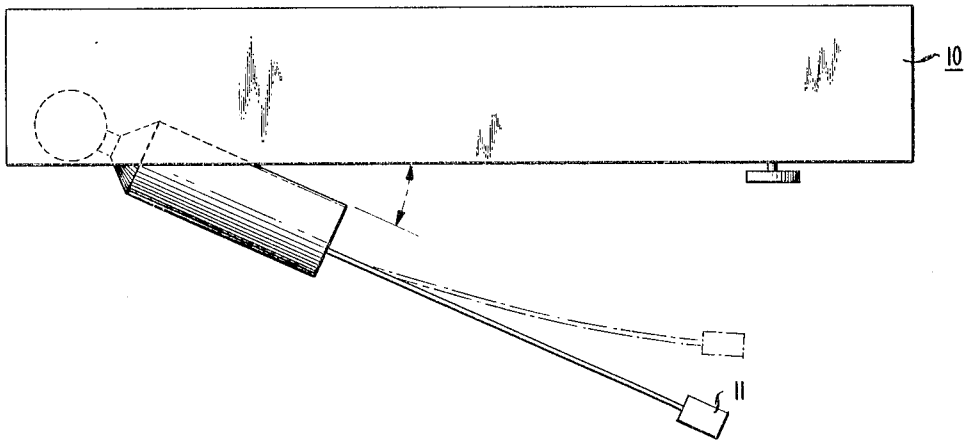
FIG. 10 is a top view of the embodiment of FIG. 1 with the microphone extended.

FIG. 10 is a top view of the embodiment of FIG. 1 with the microphone and boom extended and viewing the tape in longitudinal edge profile. In the event of a movement by the vehicle driver to his left or forward (up or to the right as illustrated in FIG. 10) the microphone 11 which has been in position in front of the driver's mouth is easily deflected to, e.g., the dotted line position illustrated in FIG. 10, because that is the single direction of free flexibility of the tape in configurations such as those illustrated in FIGS. 6 through 9.

Figure 11:
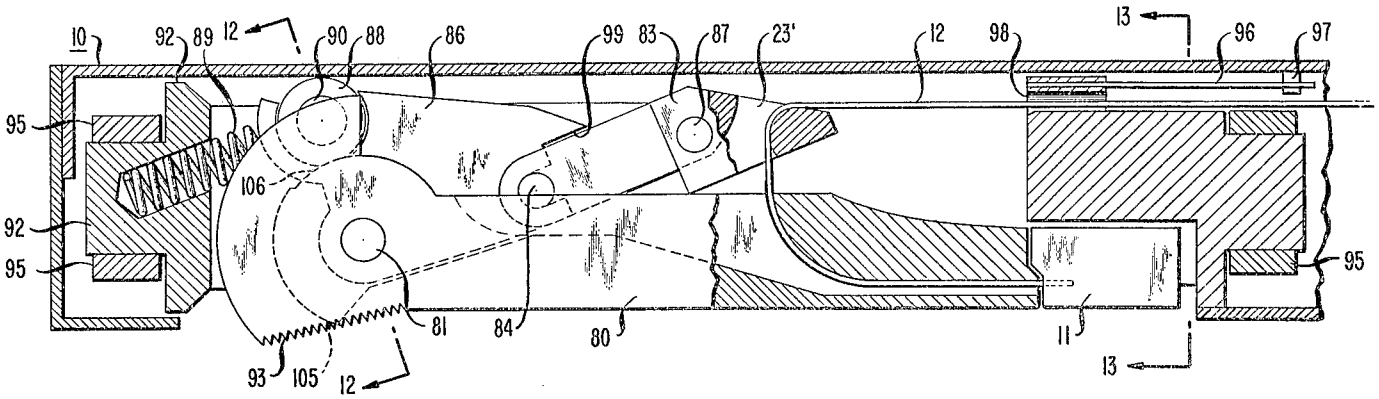
FIG. 11 is a sectional view, as in FIG. 3, of a modified tape tracking mechanism.
Figure 16:
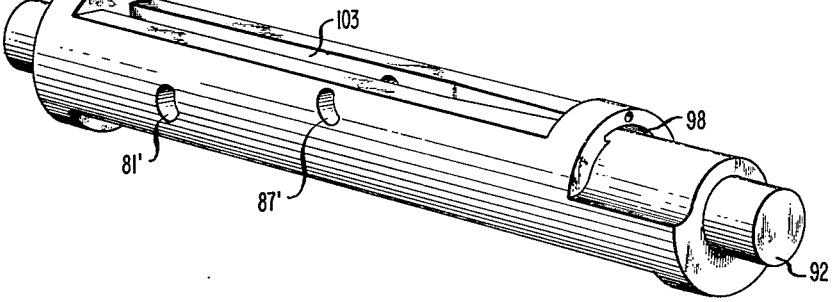

FIG. 11 shows a cross-sectional view, as in FIG. 3, of a different embodiment of the tape tracking and holding mechanism. For this case, the slider block 27 and retracting mechanisms are the same as in the right-hand portion of FIG. 3. A cylindrical swivel 92, shown in perspective in FIG. 16, is supported for rotation in housing 10 by bearings 95. A cantilever spring 96 at the right-hand end is positioned between two lugs 97 (only one of which is specifically shown) to define a central position for swivel 92 from which the swivel can be rotated about 45 degrees in either direction. Spring 96 returns to swivel to its central position when the swivel is released.

Figure 17:
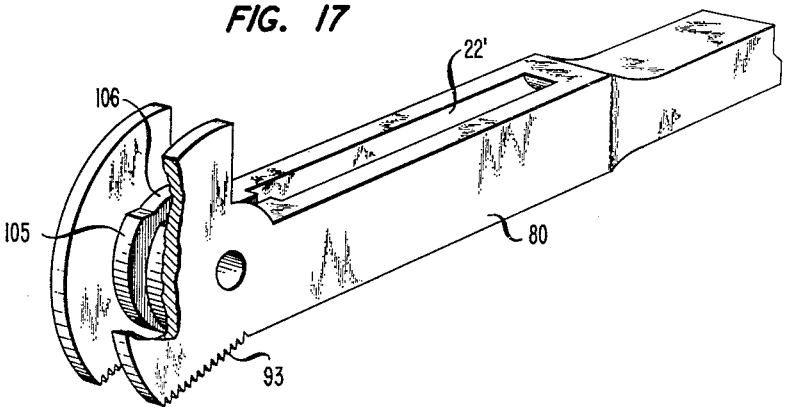

A central aperture 103, seen best in FIG. 16, extends transversely through the swivel 92 to accommodate a stub boom 80, a brake link 86, and a pivotable link 83. The boom 80, which is shown in perspective in FIG. 17, includes the aperture 22' for passage of tape 12 and is mounted for rotation on an axle 81 which is supported in receiving openings 81' (one shown in FIG. 16) in swivel 92. As shown in FIG. 11, boom 80 is in its home position in swivel 92 and is essentially flush with the surface of that swivel except for a knurled portion 93 to the left and below axle 81. A user need only apply thumb pressure to the portion 93 to turn the right-hand portion of boom 80, along with microphone 11, out of swivel 92 to facilitate the grasping of the microphone for extension. Boom 80 can thereafter be turned up to about 135 degrees clockwise from its home position.

Figure 12:
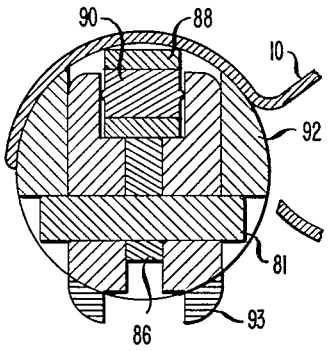
FIGS. 12 and 13 are different cross-sectional views of the embodiment of FIG. 11.
Figure 14:
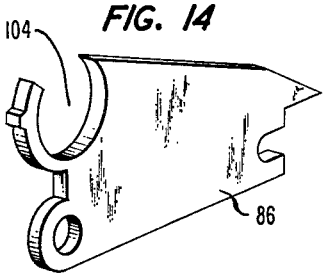
FIGS. 14–17 are perspective views of certain parts of the embodiment of FIG. 11.
Figure 15:
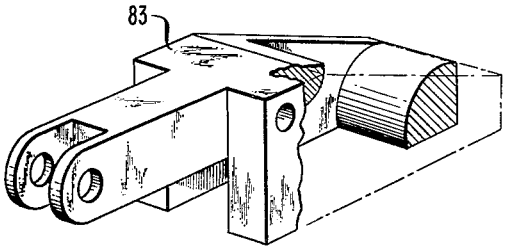

The holding mechanism includes the brake link 86, also rotatably mounted on the axle 81, and pivotable link 83 rotatably mounted, on an axle 87, in the aperture 103. Axle 87 is supported in receiving openings 87' (one shown in FIG. 16) in swivel 92. Links 86 and 83 are further illustrated in perspective in FIGS. 14 and 15, respectively. As is best seen in the cross-sectional view of FIG. 12, link 86 is positioned between the two branches of the bifurcated left end of boom 80. A pin 84 interconnects the right-hand end of link 86 and the left-hand end of link 83 so that as tape 12 is drawn out of housing 10 link 83 is turned clockwise about axle 87 and in turn drives link 86, through pin 84, in a counterclockwise direction against the action of a biasing coil spring 89. This turning moves a resilient friction member 88, with an internal reinforcement axle 90, out of engagement with the wall of housing 10 so that cylindrical swivel 92 is thereby freed to turn as required to track the position of tape 12. Member 88 floats in a saddle groove 104 in link 86 and is free of boom 80 in its home position. Member 88 is driven against the wall of housing 10 by turning a link 86 in a clockwise direction. Two radial braking surfaces 105 and 106 are provided inside each of the bifurcation branches of boom 80 to be engaged by member 88 when tape tension is released. Sector 106 has a smaller radius about axle 81 than does sector 105 so that initial rotation of boom 80 from the home position will not inadvertently actuate the braking function of member 88 even if the tension on tape 12 should be momentarily released. Since the braking mechanism, including link 86 and member 88, acts on boom 80, and both link 86 and boom 80 are mounted on swivel 92, that swivel is also held when the braking mechanism is engaged to hold boom 80. Housing 10 is dimpled adjacent to swivel 92, as shown in FIG. 12, to provide a substantially uniform braking surface in all positions of swivel 92.

When a microphone and tape extension has ended with the microphone in a user-selected position, the relaxation of tension in tape 12, as already described, releases link 83. Bias spring 89 then drives link 86 clockwise to restore braking action of member 88. Excessively forceful wedging of member 88 between housing 10 and one of the camming sectors 105 or 106 of boom 80 is prevented by a mechanical stop surface 99 on link 86 bearing against link 83.

Figure 13:
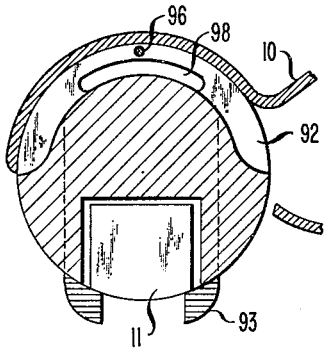

At the right-hand end of swivel 92 in FIG. 11, the tape 12 extends through a passage 98 toward block 27. That passage and the nearby spring 96 are also seen in FIG. 13. Between the passage 98 and block 27 the tape 12 can be subjected to limited twisting to accommodate rotation of swivel 92.

Although the present invention has been described in connection with particular applications and embodiments thereof, it is to be understood that additional applications, embodiments, and modifications which will be obvious to those skilled in the art are included within the spirit and scope of the invention.

I claim:

1.

A microphone support comprising an elongated member (12) having a microphone (11) mounted on one end thereof, said member being flexible in a first direction perpendicular to the longitudinal axis of said member and essentially rigid in the opposite colinear direction and in both directions perpendicular to the first direction in a plane perpendicular to said axis, the improvement in said support comprising said member being formed from an unarticulated strip of material configured to produce the aforementioned flexibility characteristic, means for removably housing (10) said member with said one end being positioned for first removal, means for guiding (13) said member during removal from a home position in said housing, and means, responsive to at least partial removal of said member from said housing, for resiliently urging (37) said member back into its home position in said housing.

2. The support in accordance with claim 1 in which means are provided for securing (28) an end of said elongated member to an interior portion of said housing, and said resilient urging means comprises constant force spring means (37), and means for slidably coupling (27) an intermediate variable portion of said elongated member to said spring means for urging said member into said housing under action of said spring means.

3. The support in accordance with claim 1 in which there are provided means, including said guiding means, for tracking (13, 20) angular orientation of said member with respect to said housing on removal, and means for holding (26) said tracking means when member removing stops, means for releasably locking (46) said urging means to hold said member at a selectable extent of removal, and means, responsive to release of said locking means, for releasing (12 acting on 24) said tracking means holding means.

4. The support in accordance with claim 3 in which said tracking means comprises a boom (13) having an aperture (22) therein through which said member passes during removal from and return to said housing, and means for swivelably coupling (20, 21) said boom to said housing and including a ball joint at one end of said boom.

5. The support in accordance with claim 3 in which said tracking means comprises a boom (80) having an aperture (22') therein through which said member passes during removal from and return to said housing, a cylindrical swivel (92) mounted for rotation about its longitudinal axis in said housing, and means for mounting (81) said boom on said swivel for rotation about an axis perpendicular to a plane including said swivel axis.

6. The support in accordance with claim 3 in which there are provided manually actuatable means for releasing (50, 57) said locking means.

7. The support in accordance with claim 3 in which there are provided means, responsive to at least a predetermined rate of deceleration of said housing following movement thereof in a predetermined direction, for releasing (52) said locking means.

8. The support in accordance with claim 7 in which there are provided means, responsive to release of said locking means by said deceleration responsive releasing means while said member is at least partially removed from said housing, for latching (48) said locking means in a lock-released position.

9. The support in accordance with claim 8 in which there are provided means for releasing (27 striking 48) said latching means upon restoring said member to its home position within said housing.

* * * * *

UNITED STATES PATENT AND TRADEMARK OFFICE

CERTIFICATE OF CORRECTION

PATENT NO. : 4,215,250

DATED : July 29, 1980

INVENTOR(S) : Baird E. Resener

It is certified that error appears in the above-identified patent and that said Letters Patent are hereby corrected as shown below:

Column 3, lines 20 and 21, "advantageously at connectable 29 the loose ends of these conductors" should read --advantageously connectable at the loose ends 29 of those conductors--.

Column 3, line 67, "perpendicularly" should read --perpendicularity--.

Column 4, line 10, "lefthand" should read --left-hand--.

Column 4, line 11, "first" should be --just--.

Column 5, line 4, "14" should be --44--.

Column 8, lines 40 and 41, "1. A microphone" should read --1. A microphone--

Signed and Sealed this

*Sixteenth* Day of *December 1980*

[SEAL]

*Attest:*

SIDNEY A. DIAMOND

*Attesting Officer*

*Commissioner of Patents and Trademarks*